US005469345A

United States Patent [19]

Pettersen et al.

[11] Patent Number: 5,469,345

[45] Date of Patent: Nov. 21, 1995

[54] LOW PROFILE FLASHLIGHT/SPOTLIGHT

[75] Inventors: Tor H. Pettersen, Rancho Palos Verdes; John F. Scherbarth, Corona; Bobby L. Hobbs, Chino, both of Calif.

[73] Assignee: Diamond Light Industries, Costa Mesa, Calif.

[21] Appl. No.: 164,354

[22] Filed: Dec. 8, 1993

[51] Int. Cl.[6] ..... F21L 1/00

[52] U.S. Cl. ..... 362/188; 362/196; 362/371; 362/267

[58] Field of Search ..... 362/188, 157, 362/196, 267, 375, 399, 371, 200, 270, 285, 289; 248/472, 471, 479

[56] References Cited

U.S. PATENT DOCUMENTS

| | | | |
|---|---|---|---|
| 2,125,038 | 7/1938 | Tompkins et al. | 362/188 |
| 2,282,167 | 5/1942 | Cullman | 362/188 |
| 3,428,800 | 2/1969 | Levin et al. | 362/289 |
| 3,543,016 | 11/1970 | Jones | 362/371 |
| 3,813,004 | 5/1974 | Andreaggi | 248/471 |
| 3,919,542 | 11/1975 | Castic | 362/267 |
| 4,410,933 | 10/1983 | Blake et al. | 362/371 |
| 4,755,921 | 7/1988 | Nelson | 362/307 |
| 5,029,060 | 7/1991 | Aho et al. | 362/299 |
| 5,134,558 | 7/1992 | Williams et al. | 362/200 |
| 5,150,966 | 9/1992 | Nelson | 362/337 |
| 5,171,086 | 12/1992 | Baloochi | 362/188 |

*Primary Examiner*—Ira S. Lazarus
*Assistant Examiner*—Sara Sachie Raab
*Attorney, Agent, or Firm*—Stetina Brunda & Buyan

[57] ABSTRACT

A low profile flashlight comprising a housing having a lens and a light source disposed therewithin. The light source is reciprocally movable between base, first and second positions within the housing and is oriented relative the lens such that a divergent beam of light is transmitted from the lens when the light source is in the first position and a collimated beam of light is transmitted from the lens when the light source is in the second position.

12 Claims, 3 Drawing Sheets

18
28
20
14
54
54
56
32
82
52
26
26b
28
38
52

44
46
16
88
64
66
88
46
88
100
88
88
62
50
48
94
92
50
48
90
94
92
90
90
42

Fig. 6
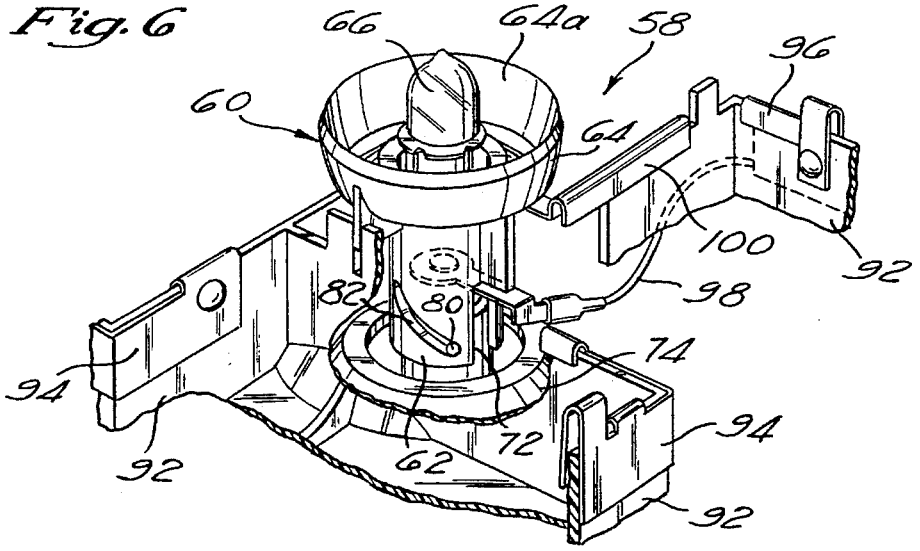
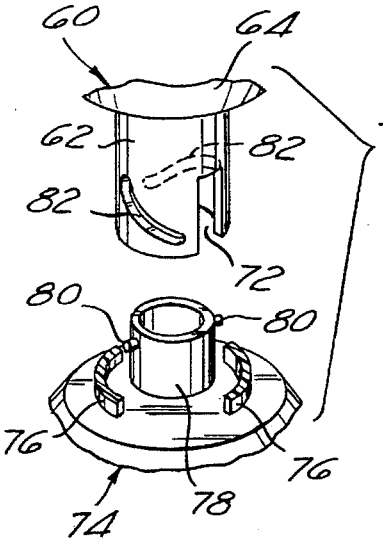
Fig. 8
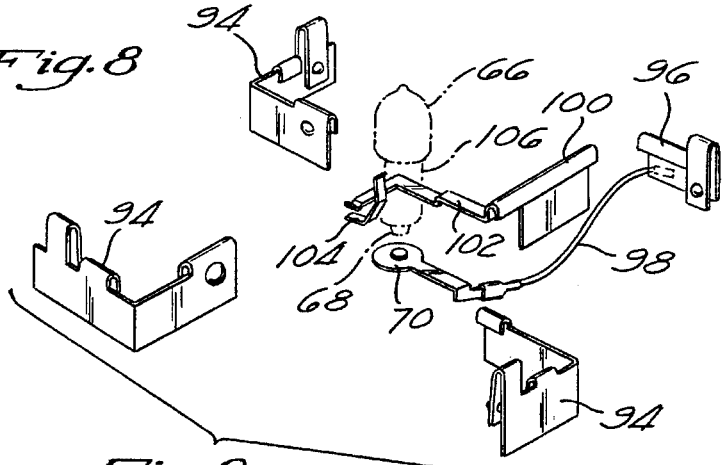
Fig. 9
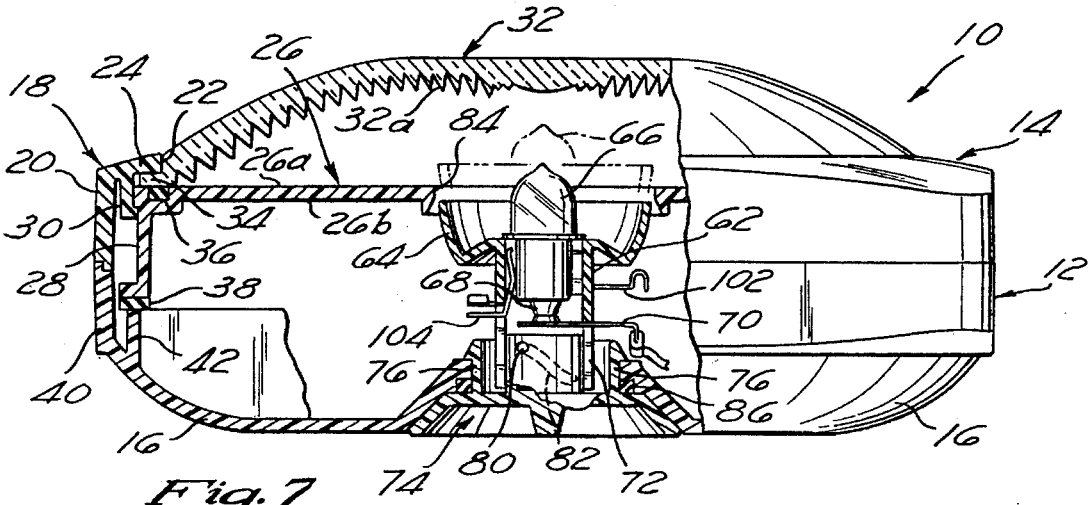
Fig. 7

LOW PROFILE FLASHLIGHT/SPOTLIGHT

FIELD OF THE INVENTION

The present invention relates generally to flashlights, and in particular to a low profile flashlight/spotlight incorporating a light source which is circumvented by plural batteries and reciprocally movable relative a lens for facilitating the transmission of divergent or collimated beams of light from the lens.

BACKGROUND OF THE INVENTION

Hand-held electric lanterns and heavy-duty flashlights are items typically found in retail outlets such as catalogue showrooms, appliance stores and household electronics stores. These devices are frequently purchased by consumers for use in the home and in relation to leisure activities such as camping, hiking or the like. The prior art electric lanterns generally comprise a housing sized to accommodate a large, rectangularly configured battery (e.g. a 12 volt lantern battery). Attached to the housing is a handle member and a lamp/lens assembly which is electrically connected to the battery disposed within the housing. The prior art heavy-duty flashlights generally comprise an elongate housing defining a hollow, cylindrically configured handle portion and a bell-shaped portion formed at one end of the handle portion. The bell-shaped portion is sized and configured to accommodate the lens and lamp of the flashlight, with the handle portion being adapted to receive four or more D-size batteries in end-to-end fashion which are electrically connected to the lamp.

Since both the electric lanterns and heavy duty flashlights are generally adapted to produce a brightness output of greater intensity than smaller conventional flashlights, the housings thereof are largely sized to accommodate the power supply needed to facilitate such light transmission, i.e., the four or more linearly aligned D-size batteries or 12 volt lantern battery. Due to the large size of the prior art electric lantern and heavy duty flashlight housings and the manner in which the battery or batteries are disposed therein, the resultant weight of the lantern or flashlight is typically both excessive and unbalanced, thus making the handling thereof cumbersome and uncomfortable.

In addition to the foregoing, the prior art electric lanterns and heavy duty flashlights are generally not adapted to alternatively generate a floodlight or spotlight by selectively diverging or collimating the beam of light transmitted from the lens. In those lanterns and flashlights which are adapted to produce both flood and spotlights, the divergence or collimation of the beam of light is generally accomplished by varying the position of a reflector relative the lamp or bulb. However, the assembly needed to facilitate the adjustment in the positioning of the reflector often comprises a large number of structural elements, thus further adding to the overall size and weight of the device.

The present invention specifically addresses the deficiencies associated with the prior art hand-held electric lanterns and heavy duty flashlights by providing a low-profile flashlight/spotlight which is adapted to selectively transmit divergent or collimated beams of light, and is provided in a thin and compact housing which is weight balanced for ease of handling.

SUMMARY OF THE INVENTION

In accordance with a preferred embodiment of the present invention, there is provided a low profile flashlight/spotlight comprising a generally square housing which itself comprises first and second housing halves releasably attachable to each other via a slide latching mechanism. Disposed within the first housing half is a lens, while disposed in the second housing half is a light source which is reciprocally movable between multiple positions within the housing. The light source is oriented relative the lens such that a divergent beam of light is transmitted from the lens when the light source is in a first position, and a collimated beam of light is transmitted from the lens when the light source is in a second position. The light source preferably comprises a reflector and a lamp which are maintained in fixed relation to each other when the light source is moved between the multiple positions.

The flashlight/spotlight further comprises a power source disposed within the second half of the housing and circumventing the light source. The power source preferably comprises four batteries positioned about the light source in a generally square orientation for balancing the weight of the flashlight and allowing for the fabrication of the housing with a thin, compact configuration.

In the preferred embodiment, the light source is moved between the multiple positions via an adjustment mechanism comprising a tubular, cylindrical member slidably engaged to the second half of the housing and defining first and second ends. Disposed in the cylindrical member adjacent the second end thereof is an opposed pair of camming grooves. The reflector is attached to the first end of the cylindrical member, with the lamp being partially inserted into the first end. The adjustment mechanism further comprises an adjustment knob rotatably connected to the second half of the housing and including a pair of extensions slidably received into the camming grooves of the cylindrical member. The camming grooves are configured in a manner wherein the rotation of the knob in a first direction causes the light source to move toward the first half of the housing, with the rotation of the knob in the second direction causing the light source to move toward the second half of the housing. The lamp is electrically connected to the power source via a spring contact which is adapted to selectively activate and deactivate the lamp during the movement of the light source between its multiple positions.

Disposed between the lens and the first half of the housing is a first seal, while disposed between the first and second halves of the housing is a second seal. Additionally, disposed between the adjustment knob and the second half of the housing is a third seal. The first, second and third seals are adapted to provide the flashlight/spotlight with a substantially water-tight construction. The housing further includes a handle member attached thereto which is adapted to carry the flashlight as well as index relative the housing to support the flashlight at multiple angular orientations upon a support surface.

BRIEF DESCRIPTION OF THE DRAWINGS

These, as well as other features of the present invention, will become more apparent upon reference to the drawings wherein:

FIG. 6 is a perspective view of the light source of the flashlight/spotlight;

FIG. 7 is a partial cross-sectional view of the flashlight/spotlight illustrating the range of movement of the light source;

FIG. 8 is an exploded view of the components comprising an adjustment mechanism associated with the light source; and FIG. 9 is a perspective view illustrating the arrangement of the electrical leads associated with the power source of the flashlight/spotlight.

DETAILED DESCRIPTION OF THE PREFERRED EMBODIMENT

Figure 1:
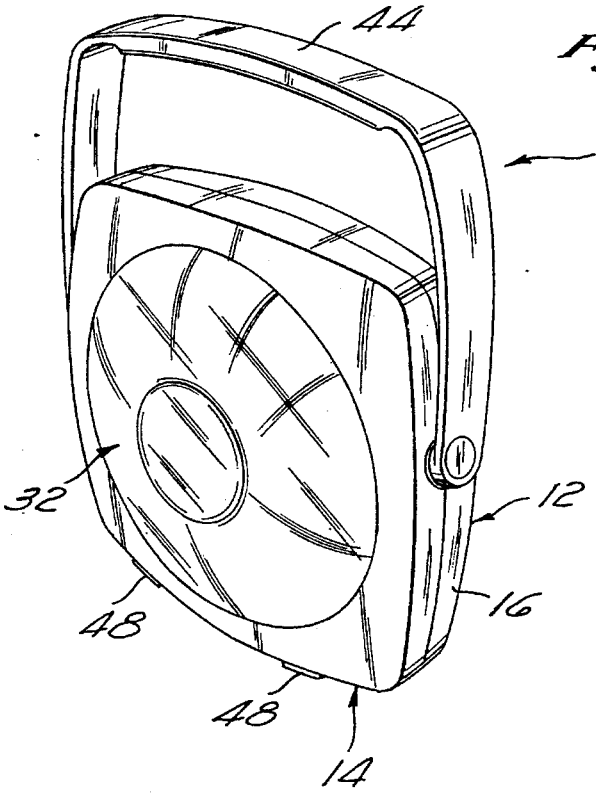
FIG. 1 is a front perspective view of the flashlight/spotlight of the present invention.
Figure 2:
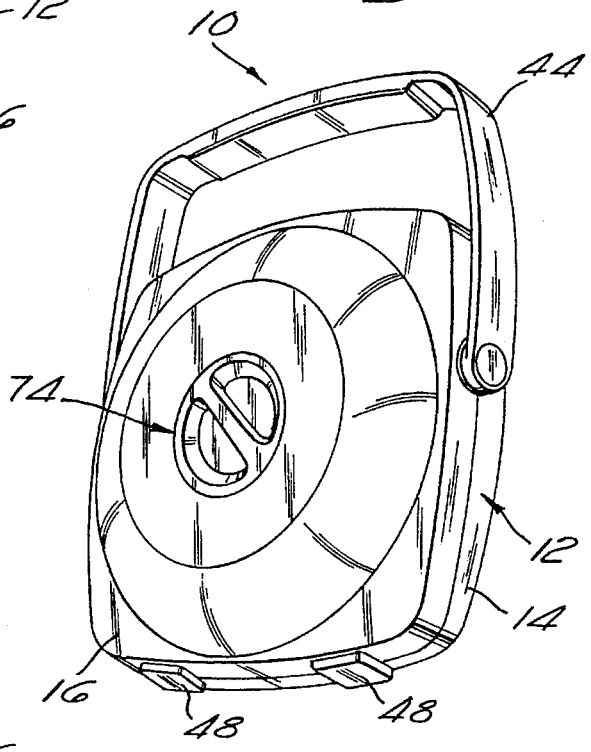
FIG. 2 is a rear perspective view of the flashlight/spotlight of the present invention.
Figure 3:
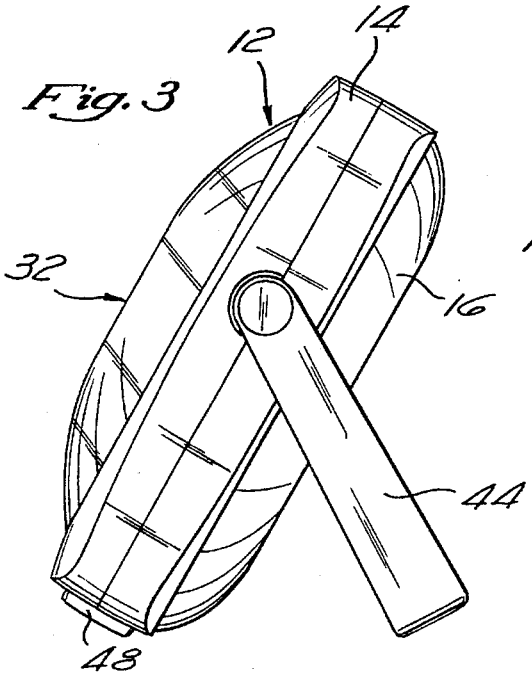
FIG. 3 is a side elevational view of the flashlight/spotlight of the present invention.

Referring now to the drawings wherein the showings are for purposes of illustrating a preferred embodiment of the present invention only, and not for purposes of limiting the same, FIGS. 1–3 illustrate front, back and side views of a low profile flashlight/spotlight 10 constructed in accordance with the present invention. In the preferred embodiment, the flashlight 10 comprises a housing 12 having a generally square configuration which itself comprises a first housing half 14 and a second housing half 16. The first and second housing halves 14, 16 are preferably releasably attached to each other via a slide latching mechanism, the structure of which will be described in more detail below.

Figure 4:
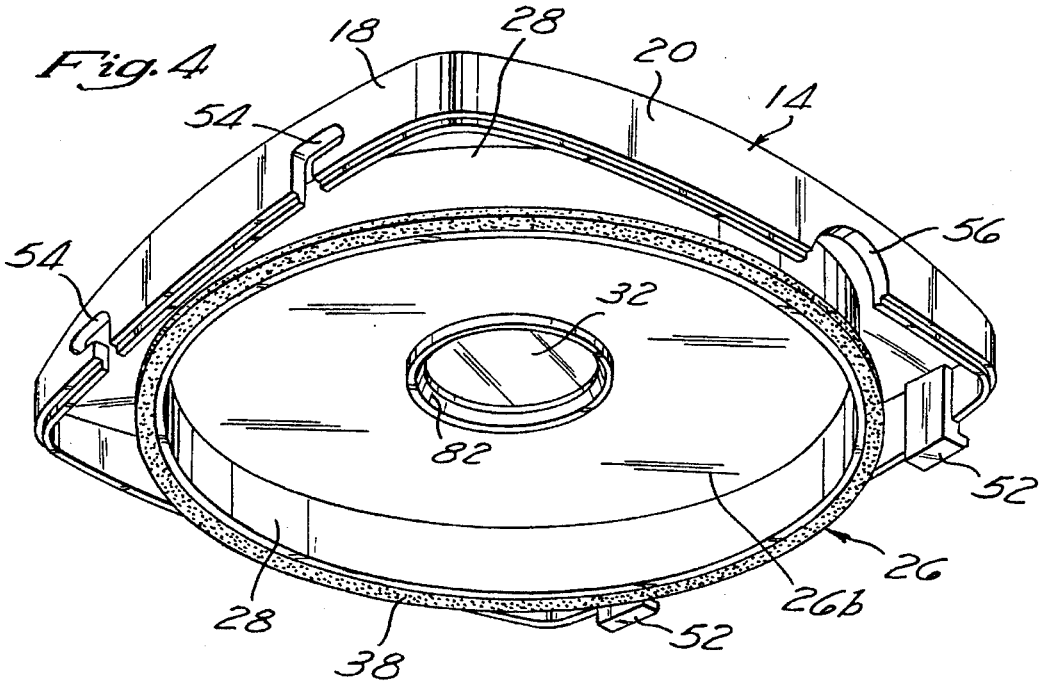
FIG. 4 is a bottom perspective view of the first half of the housing of the flashlight/spotlight.

Referring now to FIGS. 1, 4 and 7, the first housing half 14 comprises a generally square outer member 18 defining a four-sided, continuous flange portion 20 and a central opening 22 defined by a circularly configured, inwardly extending lip 24. The first housing half 14 further comprises a circularly configured inner member 26 defining generally planar top and bottom surfaces **26*a*, 26*b* and a continuous flange portion 28 extending about the periphery of and laterally relative to the bottom surface 26*b*. The top surface 26*a* of the inner member 26 is preferably coated with a layer of highly reflective material. In the preferred embodiment, the inner member 26 is releasably attached to the outer member 18 via four (4) flexible tab members 30 which are integral with and spaced equidistantly (i.e., in intervals of approximately 90 degrees) about the periphery of the lip 24 and extend in juxtaposed relation to the flange portion 20. A positive, locking engagement between the outer and inner members 18, 26 is achieved by the receipt of the distal ends of the tab members 30 into corresponding detents formed within the outer surface of the flange portion 28**.

Disposed within the first housing half 14 is a lens 32 which is preferably constructed in accordance with Applicant's U.S. Pat. No. 4,337,759 entitled RADIANT ENERGY CONCENTRATION BY OPTICAL TOTAL INTERNAL REFLECTION, the disclosure of which is expressly incorporated herein by reference. As best seen in FIG. 7, the lens 32 defines a serpentine inner surface **32*a* and a continuous, radially extending flange portion 34 which is captured between the inner surface of the lip 24 and top surface 26*a* of the inner member 26 when the outer and inner members 18, 26 are attached to each other, thus securing the lens 32 to the first housing half 14. As will be recognized, the engagement of the lens 32 to the first housing half 14 is facilitated by initially extending the arcuately contoured portion of the lens 32 through the central opening 22 such that the flange portion 34 is brought into direct, abutting contact with the inner surface of the lip 24. Thereafter, the inner member 26 is attached to the outer member 18 in the previously described manner, thus capturing the flange portion 34 of the lens 32 between the outer and inner members 18, 26. As further seen in FIG. 7, disposed between the inner member 26 and the flange portion 34 of the lens 32 is a first O-ring 36 which resides in a complimentary groove formed in the top surface 26*a* of the inner member 26. When the flange portion 34 is compressed between the lip 24 of the outer member 18 and top surface 26*a* of the inner member 26, the O-ring 36 forms a fluid-tight seal between the lens 32 and the inner member 26 for reasons which we discussed below. Attached to the distal rim of the flange portion 28 of the inner member 26 is a second O-ring 38**.

Figure 5:
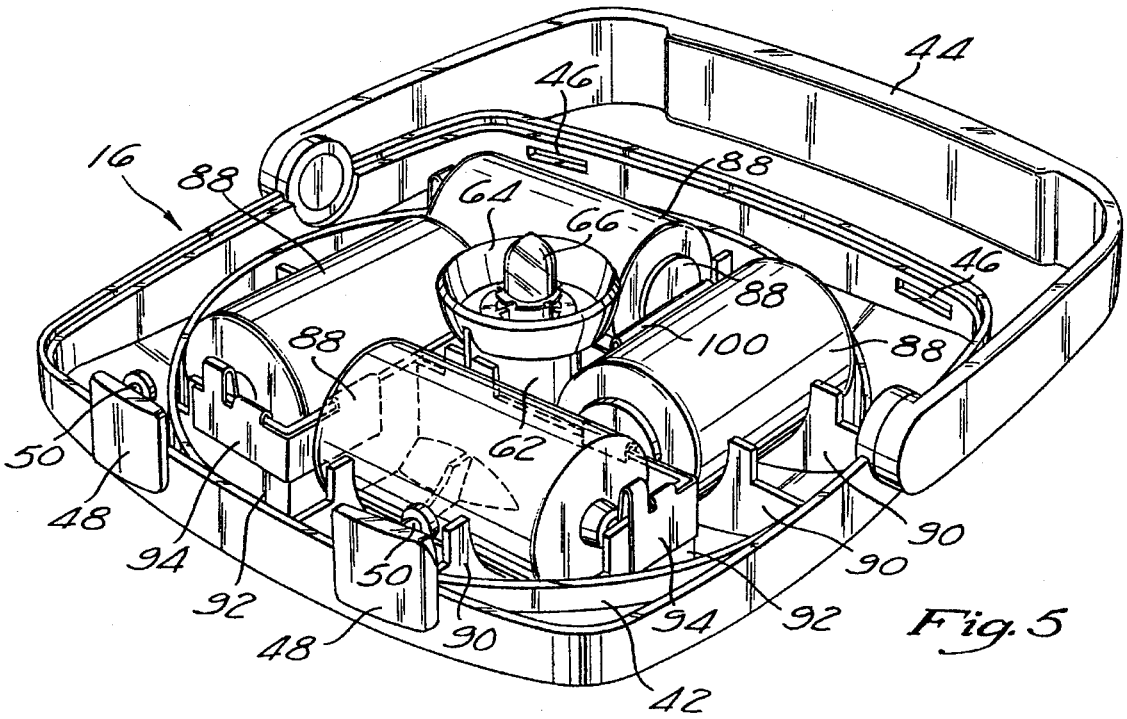
FIG. 5 is a top perspective view of the second half of the housing of the flashlight/spotlight and the components disposed therein.

Referring now to FIGS. 2, 5 and 7, the second housing half 16 also defines a generally square, four-sided flange portion 40 and an annular ring portion 42 extending about the inner surface thereof. Attached to opposed sides of the flange portion 40 is a handle member 44. The handle member 44 is adapted to index relative the housing 12 when the first and second housing halves 14, 16 are attached to each other for purposes of maintaining the lens 32 of the flashlight 10 at a desired angle of inclination relative a support surface as seen in FIG. 3. Disposed in one of the sides of the flange portion 40 to which the handle member 44 is not attached is a spaced pair of slots 46 which extend longitudinally in linear alignment with each other. Slidably attached to the side of the flange portion 40 opposite that in which the slots 46 are disposed is a pair of identically configured lock members 48, each of which defines a pin member 50 which extends inwardly toward the ring portion 42.

In the preferred embodiment, the attachment of the first housing half 14 to the second housing half 16 is facilitated by initially inserting a pair of identically configured engagement members 52 formed on one of the sides of the flange portion 20 in spaced relation into respective ones of the slots 46. As can be appreciated, the width of each of the engagement members 52 is substantially equal to the length of each of the slots 46, with the spacing between the engagement members 52 and slots 46 being identical to facilitate the receipt of the engagement members 52 into the slots 46. Subsequent to the receipt of the engagement members 52 into the slots 46, the first housing half 14 is pivoted downwardly toward the second housing half 16 so as to cause the pin members 50 of the lock members 48 to be received into the laterally extending portions of a pair of slots 54 disposed within the side of the flange portion 20 opposite that upon which the engagement members 52 are formed. Thereafter, the lock members 48 are slid outwardly (i.e., away from each other) so as to facilitate the receipt of the pin members 50 into the longitudinally extending portions of the slots 54. As will be recognized, the receipt of the pin members 50 into the longitudinally extending portions of the slots 54 maintains the first housing half 14 in locked engagement to the second housing half 16. As seen in FIG. 4, formed in the sides of the flange portion 20 which do not include the engagement members 52 and slots 54 is an opposed pair of arcuate recesses 56 which are adapted to accommodate the handle member 44 when the first and second housing halves 16, 18 are attached to each other.

The removal of the first housing half 14 from the second housing half 16 is accomplished by sliding the lock members 48 inwardly (i.e., toward each other) so as to place the pin members 50 into the laterally extending portions of the slots 54. Thereafter, the first housing half 14 is pivoted upwardly away from the second housing half 16, with the engagement members 52 then being removed from within the slots 46. In the flashlight 10, the slots 46, engagement members 52, lock members 48 and slots 54 constitute the previously discussed slide latching mechanism. Additionally, as seen in FIG. 7, when the first and second housing halves 14, 16 are attached to each other via the slide latching mechanism, the second O-ring 38 is brought into sealed engagement with the distal rim of the ring portion 42, thus forming a seal between the inner member 26 of the first housing half 14 and the second housing half 16.

Referring now to FIGS. 5–8, disposed centrally within the ring portion 42 of the second housing half 16 is a light source assembly 58. When the first and second housing halves 14, 16 are attached to each other, the light source assembly 58 is reciprocally movable between multiple positions within the housing 12, including base, first and second positions. In the preferred embodiment, the light source assembly 58 comprises a reflector 60 including a tubular, cylindrical portion 62 defining first and second opposed open ends, and a dish portion 64 formed about (i.e., circumventing) the first end of the cylindrical portion 62. In addition to the reflector 60, the light source assembly 58 comprises an electric lamp 66 which is partially inserted into the first end of the cylindrical portion 62. As best seen in FIG. 7, the lamp 66 is fully inserted into the reflector 60 when the axial terminal 68 thereof is brought into direct contact with a first electrical lead 70 positioned within the cylindrical portion 62 intermediate the first and second ends thereof. The placement of the first electrical lead 70 into the cylindrical portion 62 is facilitated by the passage thereof through a groove 72 extending longitudinally within the second end. Subsequent to being extended through the groove 72, the first electrical lead 70 is rigidly secured to the cylindrical portion 62, thus making the same part of the light source assembly 58. When the lamp 66 is properly engaged to the reflector 60, the light emitting portion thereof is centrally positioned within the dish portion 64. Like the top surface **26*a* of the inner member 26, the inner surface 64*a* of the dish portion 64** is preferably coated with a layer of highly reflective material.

As previously specified, when the first and second housing halves 14, 16 are attached to each other, the light source assembly 58 (i.e., the reflector 60 and lamp 66) are reciprocally movable between multiple positions within the housing 12. In the preferred embodiment, the movement of the light source assembly 58 between such multiple positions (e.g. the base, first and second positions) is facilitated by an adjustment knob 74 which is rotatably connected to the second housing half 16. As best seen in FIGS. 7 and 8, the adjustment knob 74 resides within a complimentary, frustoconically shaped recess formed in the center of the outer surface of the second housing half 16. The adjustment knob 74 includes at least one pair of flexible clip portions 76 which are disposed in opposed relation. The clip portions 76 are extended through an opening formed in the bottom of the knob receiving recess and rotatably engaged to the second housing half 16. In addition to the clip portions 76, the adjustment knob 74 includes a tubular, cylindrically configured portion 78 which extends axially between the clip portions 76. Extending radially from the outer surface of the cylindrical portion 78 in opposed relation is a pair of pin portions 80. The outer diameter of the cylindrical portion 78 is sized so as to be slightly less than the inner diameter of the cylindrical portion 62 of the reflector 60.

Disposed between the adjustment knob 74 and the second housing half 16 is a third O-ring 86 which resides in a complimentary, annular recess defined in the outer surface of the second housing half 16 within the recess formed therein. The third O-ring 86 forms a seal between the adjustment knob 74 and the second housing half 16. Advantageously, the three (3) fluid-tight seals formed by the first, second and third O-rings 36, 38, 86 provides the flashlight 10 with a substantially water-tight construction when the first and second housing halves 14, 16 are attached to each other.

As best seen in FIGS. 6 and 7, the reflector 60 is attached to the adjustment knob 74 via the receipt of the pin portions 80 into an opposed pair of arcuately contoured camming grooves 82 disposed within the cylindrical portion 62 adjacent the second end thereof. In the preferred embodiment, the camming grooves 82 are configured in a manner wherein rotation of the adjustment knob 74 in a first (i.e., clockwise) direction causes the light source assembly 58 to move toward the first housing half 14. Conversely, the rotation of the adjustment knob 74 in a second (i.e., counter-clockwise) direction causes the light source assembly 58 to move toward the second housing half 16. The rotation of the adjustment knob 74 in the clockwise and counter-clockwise directions is limited by the abutment of the pin portions 80 against the opposed ends of the camming grooves 82. As further seen in FIG. 7, when the pin portions 80 are abutted against the ends of the camming grooves 82 disposed closest the center of the cylindrical portion 62, as occurs when the adjustment knob 74 is rotated in a counter-clockwise direction, the light source assembly 58 assumes the base position. When the pin portions 80 are abutted against the ends of the camming grooves 82 disposed closest the second end of the cylindrical portion 62, as occurs when the adjustment knob 74 is rotated in a clockwise direction, the light source assembly 58 assumes the second position (shown in phantom). The light source assembly 58 assumes the first position intermediate the base and second positions when the pin portions 80 are positioned within the camming grooves 82 at a location intermediate the opposed ends thereof, but toward the ends of the grooves 82 disposed closest the center of the cylindrical portion 62.

When the light source assembly 58 is moved from the base position to the second position, the lamp 66 and dish portion 64 of the reflector 60 travel axially through circular opening 84 disposed in the center of the inner member 26. In the preferred embodiment, due to the configuration of the inner surface **32*a* of the lens 32 and the orientation of the light source assembly 58 relative thereto, a divergent beam of light is transmitted from the lens 32 when the light source assembly 58 is in the first position, with a collimated beam of light being transmitted from the lens 32 when the light source assembly 58 is in the second position. As will be described in more detail below, the movement of the light source assembly 58 from the first position to the base position serves to deactivate the lamp 66. Due to the configuration of the camming grooves 82, the movement of the light source assembly 58 from the first position toward the second position will cause the beam of light transmitted from the lens 32 to become increasingly collimated, with maximum collimation being achieved when the light source assembly 58 reaches the second position. Conversely, the movement of the light source assembly 58 from the second position toward the first position will cause the beam of light transmitted from the lens 32 to become increasingly divergent, with maximum divergence being achieved when the light source assembly 58 reaches the first position. As will be recognized, the reflective coating included on the top surface 26*a* of the inner member 26 and the inner surface 64*a* of the dish portion 64 intensifies the light transmitted from the flashlight 10. Due to the rigid attachment of the first electrical lead 70 to the reflector 60 and the receipt of the lamp 66 into the cylindrical portion 62, the lamp 66 and reflector 60 are maintained in fixed relation to each other when the light source assembly 58** is moved between the base, first and second positions.

Referring now to FIGS. 5, 6 and 9, the flashlight 10 further comprises a power source disposed within the second housing half 16 which circumvents the light source assembly 58. In the preferred embodiment, the power source comprises four (4) batteries 88 which are disposed within the ring portion 42 and positioned about the light source assembly 58 in a generally square configuration. As best seen in FIGS. 5 and 6, formed upon the inner surface of the second housing half 16 and extending perpendicularly therefrom within the ring portion 42 are eight (8) arcuately contoured support portions 90 and four (4) generally L-shaped wall portions 92. A pair of support portions 90 are disposed in spaced, parallel relation between each adjacent pair of wall portions 92, with each of the batteries 88 being positioned between a respective pair of wall portions 92 and upon a pair of support portions 90. As will be recognized, the support and wall portions 90, 92 are oriented within the ring portion 42 such that the batteries 88, when positioned thereupon and therebetween, assume the generally square configuration circumventing the light source assembly 58.

As best seen in FIGS. 6 and 9, attached to three of the four wall portions 92 are identically configured, generally L-shaped electrical contacts 94 which are adapted to conform to the shape of the wall portions 92 to which they are attached. Attached to the remaining wall portion 92 which does not include an electrical contact 94 interfaced thereto is a second electrical contact 96 which is electrically connected to the first electrical lead 70 via a flexible wire 98. Also attached to the wall portion 92 to which the second electrical contact 96 is attached is a third electrical contact 100 which includes an L-shaped spring contact portion 102 extending therefrom. As will be recognized, the electrical contacts 94 and second and third electrical contacts 96, 100 are oriented so as to contact the positive and negative terminals of the batteries 88 positioned between the wall portions 92. Rigidly attached to the cylindrical portion 62 of the reflector 60 is a second electrical lead 104, a portion of which is disposed in direct, abutting contact with the radial terminal 106 of the lamp 66 inserted into the cylindrical portion 62, and a portion of which protrudes radially from the outer surface of the cylindrical portion 62. Since the second electrical lead 104 is rigidly attached to the reflector 60, the same is a part of and moves concurrently with the light source assembly 58.

When the light source assembly 58 is disposed in the base position, the second electrical lead 102 is separated from the spring contact portion 102 of the third electrical contact 100 in the manner shown in FIG. 9. When the light source assembly 58 is moved from the base position to the first position via the rotation of the adjustment knob 74 in a clockwise direction, the second electrical lead 104 is moved upwardly into direct contact with the spring contact portion 102, thus energizing the lamp 66 due to the completed electrical circuit defined by the lamp 66, electrical leads 70, 104, wire 98, electrical contacts 94, 96, 100 and batteries 88. When the light source assembly 58 is moved from the first position toward the second position, the spring contact portion 102 of the third electrical contact 100 flexes toward the first housing half 14 thus maintaining contact with the second electrical lead 104 while allowing the same to move toward the first housing half 14 concurrently with the light source assembly 58. When the light source assembly 58 is returned to the first position, the spring contact portion 102 returns to its original, unflexed orientation. The movement of the light source assembly 58 from the first position to the base position breaks the contact between the second electrical lead 104 and the spring contact portion 102, thus deactivating the electric lamp 66. Advantageously, the placement of the batteries 88 in a generally square configuration about the light source assembly 58 allows for the fabrication of the housing 12 with a thin, compact configuration thus facilitating the formation of the flashlight 10 with a low profile.

Additional modifications and improvements of the present invention may also be apparent to those skilled in the art. Thus, the particular combination of parts described and illustrated herein is intended to represent only a preferred embodiment of the present invention, and is not intended to serve as limitations of alternative devices within the spirit and scope of the invention.

What is claimed is:

1. A low profile flashlight, comprising:

a housing comprising first and second housing halves which are releasably attachable to each other;

a lens disposed within the first half of said housing;

a light source disposed within the second half of said housing and reciprocally movable between multiple positions within the housing, including base, first and second positions, said light source comprising a reflector and a lamp which are maintained in fixed relation to each other when said light source is moved between the base, first and second positions; and a power source disposed within the second half of the housing and circumventing said light source;

said light source being oriented relative said lens such that a divergent beam of light is transmitted from said lens when said light source is in the first position and a collimated beam of light is transmitted from said lens when said light source is in the second position;

said beam of light becoming increasingly collimated as the light source is moved toward the second position and increasingly divergent as the light source is moved toward the first position.

2. The flashlight of claim 1 wherein said power source comprises:

four batteries positioned about said light source in a generally square configuration for balancing the weight of the flashlight and allowing for the fabrication of the housing with a thin, compact configuration.

3. The flashlight of claim 1 wherein said first housing half is releasably attached to said second housing half via a slide latching mechanism.

4. The flashlight of claim 3 wherein said slide latching mechanism comprises:

a pair of lock members slidably attached to said second housing half, each of said locking members defining a pin portion;

a first pair of slots disposed within said second housing half;

a pair of engagement members disposed on said first housing half; and a second pair of slots disposed within said first housing half;

said first and second housing halves being attached to each other via the receipt of said engagement members into respective ones of the slots of the first pair, the receipt of the pin portions of the locking members into respective ones of the slots of the second pair, and the sliding of said locking members away from each other, and said first and second housing halves being detached from each other via the sliding of said locking members toward each other, the removal of the pin portions of the locking members from the slots of the second pair, and the removal of the engagement members from the slots of the first pair.

5. The flashlight of claim 1 wherein said light source is moved between the base, first and second positions via an adjustment mechanism comprising:

a tubular, cylindrical member slidably engaged to the second half and having first and second ends and an opposed pair of camming grooves disposed therein adjacent the second end, said reflector being attached to said first end and said lamp being partially inserted into said first end; and an adjustment knob rotatably connected to said second half and including a pair of extensions slidably received into said camming grooves;

said grooves being configured in a manner wherein rotation of said knob in a first direction causes said light source to move toward said first half, and rotation of said knob in a second direction causes said light source to move toward said second half.

6. The flashlight of claim 5 wherein said lamp is electrically connected to said power source via a spring contact which is adapted to selectively activate and deactivate said lamp during the movement of the light source between the base and first positions.

7. The flashlight of claim 5 further comprising:

a first seal disposed between said lens and said first half;

a second seal disposed between said first and second halves; and a third seal disposed between said knob and said second half;

said first, second and third seals being adapted to provide the flashlight with a substantially water-tight construction.

8. The flashlight of claim 5 wherein said cylindrical member and said reflector are formed as a single component.

9. The flashlight of claim 1 wherein said housing has a generally square configuration.

10. The flashlight of claim 1 further comprising a handle member attached to said housing.

11. The flashlight of claim 10 wherein said handle member is adapted to index relative the housing.

12. A low profile flashlight, comprising:

a housing comprising first and second housing halves which are releasably attachable to each other;

a lens disposed within the first half of said housing;

a light source disposed within the second half of said housing and reciprocally movable between multiple positions within the housing, including base, first and second position; and a power source disposed within the second half of said housing and circumventing said light source;

said light source being oriented relative the lens such that a divergent beam of light is transmitted from said lens when said light source is in the first position and a collimated beam of light is transmitted from said lens when said light source is in the second position;

said beam of light becoming increasingly collimated as the light source is moved toward the second position and increasingly divergent as the light source is moved toward the first position.

* * * * *